United States Patent [19]

Taylor

[11] 3,948,637

[45] Apr. 6, 1976

[54] PROCESS FOR CLASS IV-B METALS ORE REDUCTION

[76] Inventor: Paul Franklin Taylor, P.O. Box 468, Crossville, Tenn. 38555

[22] Filed: June 10, 1974

[21] Appl. No.: 478,345

[52] U.S. Cl. ..... 75/1 T; 75/84

[51] Int. Cl.[2] ..... C22B 1/00; C22B 34/10

[58] Field of Search ..... 75/1, 84, 3

[56] References Cited

UNITED STATES PATENTS

| | | | |
|---|---|---|---|
| 2,527,257 | 10/1950 | Judd | 75/1 |
| 2,974,014 | 3/1961 | Hoekje | 75/1 |
| 3,765,869 | 10/1973 | Schierloh | 75/3 |
| 3,811,865 | 5/1974 | Ladell | 75/3 |

*Primary Examiner*—P. D. Rosenberg

[57] ABSTRACT

Ores containing oxides of Titanium, Zirconium and Hafnium metals are reduced by mixing them in the powdered state with a base hydroxide of one of the Classes I-A or II-A metals of the periodic table of elements and either sugar or starch, mixing them well, then heating the mixture until ignition begins and maintaining the necessary heat until ignition is finished. The remaining residue is then flushed and boiled with water to remove waste chemicals, leached with hydrocarbon solvents, hydrochloric acid, again boiled with water, flushed, dryed, and then smelted to Class IV-B metal powder or ingot.

20 Claims, No Drawings

PROCESS FOR CLASS IV-B METALS ORE REDUCTION

Instant invention embodies another method for reducing the Class IV-B metal ores; is known specifically as the reduction of the oxides in which the metals exist as component parts; known herein as CLASS IV-B METALS ORE REDUCTION. Specifically it is improvement in the state of the art for such ore reductions.

Other known processes for such ore reductions are accomplished by; heating Class IV-B ores within an enclosed and atmospherically controlled furnace environment and in the presence of the elements Carbon and Chlorine gas. The carbon ursurps the oxygen of the ores and the chlorine combines with the metal to form salts which are condensed and collected, then injected into vacuum-inert furnaces operating at low temperatures and into molten Class I-A or II-A metal so as to remove the chlorine from the salts and thereby freeing the metal. The sponge-like metal is then further refined to produce the metal; also such ore reductions are accomplished by subjecting powdered Class IV-B ores to a chemical liquid solution formula in which they are boiled in the presence of a limestone catalyst, then leached and flushed, dryed, further leached of phosphide, and smelted by several methods to produce the metal.

Instant invention provides for these metal ore reductions by the very simple manner of heating the mixed ingredients within either an atmospheric or vacuum controlled furnace environment until ignition starts, then allowing the burning within the reduction area to continue until completed, removing and leaching the resultant material by boiling in water, flushing, subjecting to hydrochloric acid, hydrocarbon solvent compounds and the like, final boiling and flushing, drying and smelting to produce the metal.

As starting materials for this process powdered or pulverized Class IV-B metal ore is mixed with a base hydroxide of one of the Classes I-A or II-A metals with either sugar or starch. The ore is of the following types; rutile, and the titanium ore product ($TiO_2$, titanium dioxide) as may be extracted from ilmenite ore; baddeleyite and the like zirconium ore product ($ZrO_2$, zirconium dioxide) as may be extracted from zirconia silicate; hafnium ore as included in and a part of the zirconium ore (and is chemically $HfO_2$). The sugar and starch are of such chemical combinations (compounds) as Sucrose ($C_{12}H_{22}O_{11}$), Glucose ($C_6H_{12}O_6$), Fructose ($C_6H_{12}O_6$), and starch ($C_6H_{10}O_5$).

When the selected ore and other starting materials are mixed good and heated within an appropriate reduction container with endothermic heat a chemical reaction results among the materials so as to produce a hydrocarbon fuel which then burns by extracting the oxygen from the ores and other reduction materials, and by such exothermic action the consequent reduction of the ores.

It is, therefore, an object of the instant invention to provide another method for the reduction of Class IV-B metal ores by the main feature of heating the mixed component materials to produce hydrocarbon fuel which burns by extracting the oxygen from the ores.

It is another object of the instant invention to provide a much simpler and more economical manner for the reduction of such ores than that provided for in other known reduction processes by the advantage of producing hydrocarbon fuel within the reduction medium by heating (endothermic) then burning the fuel with oxygen as extracted from the ores (exothermic); such reductions being accomplished within either atmospheric or vacuum controlled furnace environments.

Other objects and advantages of the instant invention improvement will become apparent from a further reading of the description and the appended claims.

With the above and other objects in view; the present invention mainly comprises in another process for separating the Class IV-B metals from the chemically combined element oxygen; featuring greater ease of reduction operations, production of high grade metal, and one that is more economically advantageous than that afforded in other reduction processes of such ores; by utilizing the advantage of deriving a hydrocarbon fuel from such heated mixtures and then burning it with the oxygen as driven off chemically from the ores.

The process begins with the stated mixing together of the starting materials within a suitable container, then heating the container and mixture within proximity of a suitable furnace arrangement where effective heat may be applied to it.

The mixture is then heated until ignition of the mixture results and goes to completion. It is attended by such mechanical arrangement as necessary for collecting and venting of the combustion flue gases.

The temperature operation range throughout the burning (ignition) period is that which is necessary to maintain ignition until sufficient produced fuel is oxidized and the ores properly reduced. This is in the approximate range of 650°F. through 1200°F.

With the reaction terminated sufficient time is allowed for cooling and then the container is emptied of the residue. Water is added to the residue within a suitable container and residue is stirred so that waste chemicals and dross will go into solution with the water and is decanted off.

With sufficient water rinsings of the residue metal powder will result, free from these chemical wastes.

Metal powder may then be subjected to further cleansing and leaching with such conventional agents as selected by the operator for the further removal of such contaminants; such agents being acids, detergents, hydrocarbon solutions, etc. Powder is then boiled with water and rinsed until clean of all such dross, after which it is carefully dried in such manner so that it will not re-oxidize with component gases of the atmosphere, which effect may be both hazardous and result in spoiled product.

The reduced, cleansed and dried powder may then be smelted to refined powder, or to ingot form, by conventional furnace mechanisms and techniques known and standard for the refinements of such Class IV-B metal powder. Or, at this stage it may be utilized as is commercially within the vacuum-inert plasma arc furnace environment for plating upon other metal, forming metal ingot, and producing a more commercially pure form of Class IV-B metal powder.

Thus, from the instant Class IV-B metal ore reduction commercially pure or semi-pure grade powder and ingot may be the resultant form as herein stated and claimed, and with proper smelting and refinement of same.

OPERATIONAL EXAMPLE 1— FOR TITANIUM METAL ORE REDUCTION

The operation for titanium metal ore reduction as derived from the foregoing specification may be exemplified more particularly by an explanation for the reduction of a 1-pound batch of titanium ore ($TiO_2$), which the inventor has operated successfully. Examples of other batch volumes will not herein be given for titanium ore because inventor has reduced various batch volumes and found the ingredient ratios for all such batches remain in the approximate same proportion as the given example.

The reduction equipment consists of; a vertical gas-fired furnace, circular in shape and opening from the top with a removable cover, and with a motor powered blower; a silicon-carbide crucible made circular in shape so as to fit within the furnace, and being approximately twelve inches tall and six inches wide; a stainless steel boiling vessel for later cleansing, leaching, and boiling the residue powder material, and for drying it over a provided hot plate or burner; and a suitable stirring rod or instrument preferably of stainless steel or the equivalent.

Introduced within the crucible are the mixed ingredients consisting of; one pound Rutile ($TiO_2$) pulverized to −325 mesh grade; one cup (measuring) of sodium hydroxide (NaOH); one cup of sugar ($C_{12}H_{22}O_{11}$). Good mixing is emphasized so all ingredients are in reduction contact.

The gas furnace is then fired and allowed to heat until the mixture begins to boil, at which time it ignites from the furnace flame. This is approximately 650°F. The furnace burner is allowed to heat for 2 or 3 minutes longer and then shut off. The mixture within the crucible continues to burn briskly. After about 5 minutes of burning the furnace is again fired and allowed to again heat the crucible for about five minutes. This is repeated two or three times until mixture has burned completely. At the final furnace burn the residue and crucible are allowed to heat at from about 1,000°F. to 1,200°F. This causes the last of the carbon of the mixture to unite with the last of the oxygen of the ore so as to form carbon monoxide (CO) and by so doing completely reducing the ore. Care must be exercised that an excessive amount of heat is not applied (endothermic) or otherwise the ore will re-oxidize from the gases of the atmosphere and consequently spoiled. For this reason the exact and same operation as described within this example may be accomplished but within an outgassing atmospherically controlled crucible or reduction vessel sufficient to maintain such inert-vacuum qualities that such re-oxidization cannot transpire even up to the melting points of the Class IV-B metals so reduced. Such a system is herein pointed out and specifically claimed within instant application. Further that when such a system is utilized it must be remembered that the hydrocarbon gases formed when mixture begins to boil are potentially explosive, and that the internally released oxygen (from the ores and other ingredients) will support the burning. Therefore, care must be exercised that such an atmospherically controlled outgassing system is properly ignited before the heat becomes too high from the furnace (endothermic); that without such proper ignition (prior to the kindling point that may be reached at red heat of the crucible) explosion and hazard may result.

When the reduction is finished the crucible is removed from the furnace and allowed to cool. Residue material is then removed and placed within the flushing vessel.

Water is then added and residue stirred and crushed so no lumps or chunks exist. The contents are then boiled for about 15 or 20 minutes, with stirring, after which it is allowed to settle out and then liquid dross poured off, leaving the Class IV-B powder. This is repeated two or three times until powder is cleansed, and then flushed with water sufficiently to completely cleanse. Optionally the powder may be put within such a container that hydrochloric acid (weak) may be added, with stirring, so that any metals other than the Class IV-B ones will be dissolved into solution to be decanted from the residue powder. This would then be again followed by boiling in water and so flushed until cleansed. Powder is then dried in such manner within the flushing vessel that it will not re-oxidize with component gases of the atmosphere.

Class IV-B powder is then transported to smelting operations within the plasma arc vacuum-inert furnace where it is formed into ingot, plated on other metal, or made commercially pure product for the commercial using market. Or, the powder may be utilized as is as optionally pure or semi-pure commercial grade metal powder, as controlled by the reduction operations. Or, it may be formed into ingot-like rods for electrode smelting within vacuum-inert furnaces operating at the melting point of the particular metal. Or, it may be fed into molten alkali-metal bath vacuum-inert furnaces operating at lower temperatures for forming into sponge-like Class IV-B metal.

The ingredient ratios for instant example for Titanium metal are not necessarily confined to those as given (and all batch sizes). Example ratios represent a norm and the ingredients may vary lower or higher with respect to any other of the ingredients, as reduction effectiviness and requirements dictate. This is reflected in the definite weight of the ore being reduced (in this example 1 pound), but volume (cup) measurements for the other ingredients.

OPERATIONAL EXAMPLE 2 — FOR ZIRCONIUM-HAFNIUM METAL ORE REDUCTION

The operation for zirconium-hafnium metal ore reduction as derived from the foregoing specification is accomplished exactly as is the above example (1) for Titanium, and with the exact and same reduction equipment. The only difference is; about one and one-half pounds of zirconium-hafnium ore are added to one cup of sodium hydroxide and one cup of sugar instead of the one pound of rutile in above example. The zirconium-hafnium ore ($ZrO_2$-$HfO_2$) is pulverized to either −325 or −400 mesh grade and the sodium hydroxide and sugar are of the same like types as utilized in above example (1). This is due to varying atomic weights of titanium and zirconium-hafnium ores with respect to constant volumetric amounts.

Also the smelting and usage of the finished metal powder is as outlined above for Titanium metal.

Also the ingredient ratios are synonymous to the titanium ores with respect to the zirconium-hafnium ores.

CLASS IV-B METALS ORE REDUCTION CHEMISTRY

With heating of such ores as given in examples 1 and 2 in the presence of some form of sugar or starch and a base hydroxide as formed from metals of the Classes I-A or II-A periodic groups hydrocarbon gases are formed comparable to Methane gas ($CH_4$), gasoline-like ($C_6H_{14}$), and other of the hydrocarbon compounds possibly to the crude ($C_nH_{2n+2}$). The oxygen from the ores and other reduction components is released and unites with the fuel to support the combustion reactions (oxidation), and so until such materials are consumed out of the mixture with the ores being thereby reduced to the metals.

The manufacture of such fuel from the heated reduction component materials presents new energy sources; as being brought forth chemically by the applying of sufficient endothermic heat so as to provide necessary chemical reactions. In instant application it is burned (exothermic) as quickly as formed by the oxygen released from the ores and other component materials so as to reduce the ores, however, in applications to provide fuel from such arrangements and materials it would not be therein burned but collected as fuel.

What is claimed as new and desired to be secured by Letters Patent is:

1. A method of reducing titanium dioxide to titanium metal comprising the steps of: (A) Adding powdered titanium dioxide to materials selected from the group consisting of sugar and starch, and a base hydroxide, (B) mixing, and adding to a reduction container, (C) applying heat to the mixture until combustible materials burn, (D) adding water, boiling and flushing, (E) leaching with hydrochloric acid and hydrocarbon solvents, (F) again adding water, boiling and flushing, then (G) drying, and (H) smelting the remaining material to produce titanium metal.

2. A method of reducing zirconium dioxide to zirconium and hafnium metal comprising the steps of: (A) Adding powdered zirconium dioxide to materials selected from the group consisting of sugar and starch, and a base hydroxide, (B) mixing, and adding to a reduction container, (C) applying heat to the mixture until combustible materials burn, (D) adding water, boiling and flushing, (E) leaching with hydrochloric acid and hydrocarbon solvents, (F) again adding water, boiling and flushing, then (G) drying, and (H) smelting the remaining material to produce zirconium and hafnium metal.

3. The process of claim 1 wherein the titanium dioxide is in the form of a rutile, and the titanium product as derived from ilmenite ore.

4. The process of claim 1 wherein the sugar and starch are in the forms of Sucrose ($C_{12}H_{22}O_{11}$), Glucose ($C_6H_{12}O_6$), Fructose ($C_6H_{12}O_6$), and starch ($C_6H_{10}O_5$).

5. The process of claim 1 wherein the base hydroxide is a member of one of the Classes I-A or II-A metals of the periodic table.

6. The process of claim 1 wherein the reduction container is subjected to standard atmospheric environment at reduction area.

7. The process of claim 1 wherein the reduction container is subjected to controlled vacuum-inert atmospheric environment at reduction area, and from which gases may exit.

8. The process of claim 1 wherein the burning is caused by the chemical union of hydrocarbon gases created within the process mixture and the oxygen from the process ore.

9. The process of claim 1 wherein the smelting is accomplished by subjecting the residue powder to a vacuum-inert plasma arc furnace environment (electrical).

10. The process of claim 1 wherein the smelting is accomplished by the forming of electrode-type ingot rods from the residue powder and insertion of same within vacuum-inert furnace environments.

11. The process of claim 1 wherein the smelting is accomplished by inserting the residue powder into molten alkali-metal bath vacuum-inert furnace environments.

12. The process of claim 11 wherein the zirconium dioxide is in the form of baddeleyite, and the zirconium product as derived from zirconium silicate.

13. The process of claim 11 wherein the sugar and starch are in the forms of Sucrose ($C_{12}H_{22}O_{11}$), Glucose ($C_6H_{12}O_6$), Fructose ($C_6H_{12}O_6$), and starch ($C_6H_{10}O_5$).

14. The process of claim 11 wherein the base hydroxide is a member of one of the Classes I-A or II-A metals of the periodic table.

15. The process of claim 11 wherein the reduction container is subjected to standard atmospheric environment at reduction area.

16. The process of claim 11 wherein the reduction container is subjected to controlled vacuum-inert atmospheric environment at reduction area, and from which gases may exit.

17. The process of claim 11 wherein the burning is caused by the chemical union of hydrocarbon gases created within the process mixture and the oxygen from the process ore.

18. The process of claim 11 wherein the smelting is accomplished by subjecting the residue powder to a vacuum-inert plasma arc furnace environment (electrical).

19. The process of claim 11 wherein the smelting is accomplished by the forming of electrode-type ingot rods from the residue powder and insertion of same within vacuum-inert furnace environments.

20. The process of claim 11 wherein the smelting is accomplished by inserting the residue powder into molten alkali-metal bath vacuum-inert furnace environments.

* * * * *